US009958224B2

(12) United States Patent
Agnelli, Jr.

(10) Patent No.: US 9,958,224 B2
(45) Date of Patent: May 1, 2018

(54) PISTOL FRAME DISASSEMBLY BED

(71) Applicant: Vincent R. Agnelli, Jr., Catlett, VA (US)

(72) Inventor: Vincent R. Agnelli, Jr., Catlett, VA (US)

( * ) Notice: Subject to any disclaimer, the term of this patent is extended or adjusted under 35 U.S.C. 154(b) by 63 days.

(21) Appl. No.: 15/062,052

(22) Filed: Mar. 5, 2016

(65) Prior Publication Data

US 2017/0254607 A1 Sep. 7, 2017

(51) Int. Cl.
*F41C 9/00* (2006.01)
*F41A 11/00* (2006.01)
*F41C 3/00* (2006.01)

(52) U.S. Cl.
CPC ..... *F41A 11/00* (2013.01); *F41C 3/00* (2013.01)

(58) Field of Classification Search
CPC .. F41A 11/00; F41A 23/18; F41C 3/00; F41C 33/06
USPC ..... 42/108
See application file for complete search history.

(56) References Cited

U.S. PATENT DOCUMENTS 439,562 A * 10/1890 Richards ..... F41C 33/06 206/317
750,817 A * 2/1904 Crenshaw ..... F41C 33/06 206/317
2,805,507 A * 9/1957 Buquor ..... F41C 27/16 206/317
3,780,487 A * 12/1973 Munson ..... F41C 33/06 206/317
4,438,913 A 3/1984 Hylla
4,446,900 A * 5/1984 Markovich ..... A45C 13/02 206/317
4,466,537 A * 8/1984 McMahan ..... F41C 33/0218 206/3
4,548,392 A * 10/1985 Rickling ..... F41A 23/00 269/156
5,009,088 A * 4/1991 Cislo ..... F41C 33/06 109/51
5,048,682 A * 9/1991 Taylor ..... F41C 33/06 206/317
5,172,575 A * 12/1992 Fisher ..... E05L 337/20 206/317
5,662,219 A * 9/1997 Tschudy ..... A45C 13/02 150/113
6,547,070 B1 * 4/2003 Kolpin ..... F41C 33/06 190/102
6,725,534 B1 4/2004 Schwartzbauer
6,880,239 B1 4/2005 Jennings et al.
8,201,314 B2 6/2012 Miller et al.
8,281,477 B2 10/2012 Munster et al.
8,899,416 B2 * 12/2014 McDonnough ..... A45C 13/02 206/373

(Continued)

*Primary Examiner* — Samir Abdosh
(74) *Attorney, Agent, or Firm* — Jonathan Brown

(57) ABSTRACT

A pistol frame disassembly bed ("PFDB") that offers a steady platform for disassembling and reassembling pistols, in a safer and controlled manner. The PFDB is in the overall configuration of a box with a pistol bed having a bed depression for holding a pistol frame, a trigger mechanism housing aperture, and a drawer. The top surface of the PFDB incorporates the pistol bed which is a three-dimensional depression in relation to the top of the PFDB. The pistol bed is in the shape of a side of a pistol frame (receiver) to accommodate a suitable type of pistol.

17 Claims, 5 Drawing Sheets

(56) References Cited

U.S. PATENT DOCUMENTS

| | | | | |
|---|---|---|---|---|
| 2003/0121741 | A1* | 7/2003 | Japchen | A45C 13/18<br>190/101 |
| 2006/0290492 | A1* | 12/2006 | Jidas | G08B 13/08<br>340/545.6 |
| 2012/0005937 | A1 | 1/2012 | Milino | |
| 2013/0318850 | A1 | 12/2013 | Holmes et al. | |
| 2015/0159972 | A1* | 6/2015 | Folk | F41A 35/00<br>29/426.2 |

* cited by examiner

PISTOL FRAME DISASSEMBLY BED

CROSS REFERENCE TO RELATED APPLICATION(S)

This application claims the benefit of U.S. Provisional Application No. 62/177,725 entitled "PISTOL FRAME DISASSEMBLY BED," filed on Mar. 23, 2015, the subject matter of which is hereby incorporated therein by reference in its entirety.

TECHNICAL FIELD OF THE INVENTION

The present invention relates to the general art of pistol maintenance and repair and more specifically to devices and methods for disassembly and reassembly of pistol frames.

BACKGROUND OF THE INVENTION

Manufacturers of weapons such as semi-automatic pistols, as well as other firearms, recommend that owners have them on a regularly scheduled maintenance program. Regular maintenance allows each owner and/or user to clean their pistol regularly, to perform any routine maintenance a pistol might need, to periodically inspect the pistol to remove accumulated dirt, and other foreign material and perform upgrades.

It is further and more specifically recommended that each owner/user disassemble, clean, and lubricate each pistol after each use or at least on a regularly scheduled basis. In this process the pistol frame and trigger system are disassembled so that the entire mechanism can be cleaned and/or lubricated.

However, disassembly is a chore many gun owners avoid or put off as long as possible because disassembly is often a difficult and frustrating task. To properly disassemble a firearm such as a pistol, stability of the pistol itself is required, or at the least, very helpful. Stability is difficult to achieve because pistols are not of a symmetrical shape such as a square or circle, making them awkward to hold and try to clean. A pistol has a number of small, parts and as these are removed, they must be carefully accounted for. If a pistol is being held or supported in an unstable way, the parts can slip and roll or bounce away. Depending on the size, shape and color of a part that slips away, it can be difficult or even impossible to locate. Lost parts will make a firearm unsafe or completely inoperable.

Further, tools are usually required to disassemble a pistol, such as punching tools or hammers. If a pistol is unsupported or supported inadequately, the tool may slip and scratch or otherwise damage the pistol. This kind of damage, depending on where it is on the pistol and degree, can damage the aesthetics of the firearm or even damage its functioning. If the damage is beyond aesthetic, it can present a safety issue.

To deal with this issue, a pistol can be placed in a clamp type device, as known in the art, but the pistol might be damaged at the point at which clamp pressure is being applied. Also this does not address the problem of the possibility of parts becoming separated and flying or bouncing somewhere else. The most common procedure is probably to lay a pistol out on a flat surface for disassembly. This procedure does not address either problem, as the pistol is unstable whenever worked upon, so that either parts can be lost or the pistol can be damaged.

Accordingly, there is a need in the art for a device and method that offers a steady platform for disassembling and reassembling pistols, in a safer and more controlled manner for repairs, maintenance and upgrades, that makes the pistol immobile, stable, easy to work on, and helps insure that the smaller parts of the pistol do not get lost.

SUMMARY

A Pistol Frame Disassembly Bed (PFDB) is disclosed. The PFDB is generally in the overall configuration of a box, and is comprised, generally, of a pistol bed having a bed depression for holding a pistol frame, a trigger mechanism housing aperture, and a drawer.

The top surface of the PFDB incorporates the pistol bed. The pistol bed is a three-dimensional depression, depressed in relation to the top of the PFDB. In this embodiment, a pistol to be disassembled is comprised of a slide assembly portion and a frame (receiver) portion. The pistol bed is in the shape of a side of a pistol frame (receiver) to accommodate it. The pistol bed can be sized and shaped to neatly and snugly accommodate a specific type of pistol.

The PFDB can be manufactured in any suitable size and configuration, depending upon such factors as what specific type of firearm the PFDB is to accommodate and materials of construction.

At a portion of the top of the PFDB, there can be a three-dimensional trigger mechanism housing aperture, designed specifically to hold a trigger mechanism housing.

A drawer is located at the bottom of the PFDB. The drawer is slightly smaller than the length and width of the housing of the PFDB. To open the drawer, a user simply holds the handle and pulls the drawer from the PFDB. The drawer in this embodiment is designed to open from the front; however, it can be designed for convenience sake to open from any of the four sides, depending upon the pistol model. The drawer may optionally contain a divider from front to back, or side-to-side, to help keep different parts separated, and for structural support if necessary.

The pistol bed is typically comprised of several different general areas corresponding to portions of the frame. The pistol bed is generally comprised of a forward frame area, a rear frame area, and a pistol grip receiving area.

The depth of the pistol bed will typically vary slightly among the respective areas and within each area to accommodate the shape of the frame. The pistol bed is further comprised of a depressed trigger guard area, which typically has a depth somewhat less than that of the rest of the pistol bed.

The pistol bed and bed wall can be covered in a soft material to protect the pistol frame, or a protective coating can be placed in strategic areas of the pistol bed to prevent scratching or other damage during the disassembly and reassembly process. The user will have complete control over the work as it sits in the PFDB.

The PFDB has pass-through apertures located at suitable locations as needed on the pistol bed that go through to the drawer below.

A trigger mechanism housing aperture is present in roughly the shape of a triangle with one curved side in a typical embodiment. The trigger mechanism housing aperture like the other parts herein, can be of any appropriate dimension for the pistol(s) for, which the PFDB is being used.

The materials of construction of the PFDB, or its constituent parts, can be any as known and suitable in the art, including but not limited to wood, metal, plastic or resin, or other suitable materials. The size and materials of construction of the PFDB and its individual parts may vary, depending on several factors, such as the pistol(s) the unit is designed for, the materials of construction and manufacturing process used. To achieve the desired strength, durability and efficiency of the PFDB, the planning, design and manufacturing stage will determine the exact size of the PFDB depending upon the material used.

Further, the PFDB can be produced in a number of different, or even slightly different, models. The basic pistol bed and configuration of bed wall of the PFDB can be modified to accommodate different designs, sizes and shapes of pistols, of various manufacturers.

DETAILED DESCRIPTION OF PREFERRED EMBODIMENTS

Other objects, features and advantages of the invention will become apparent from a consideration of the following detailed description and the accompanying drawings. The following descriptions are made referring to the figures, wherein like reference numbers refer to like features throughout this description. Not all numbers appearing in one figure are necessarily present in another.

Figure 1:
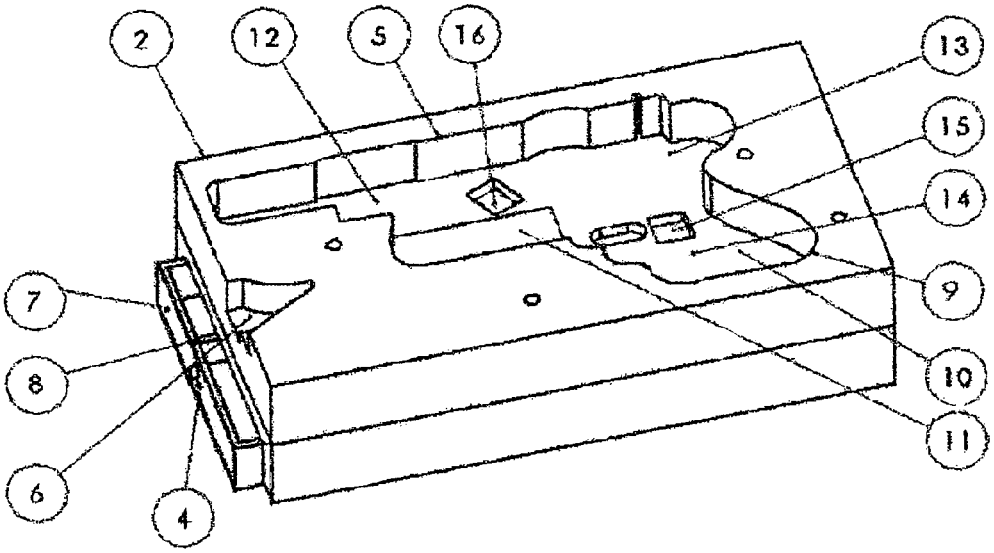
FIG. 1 is a schematic perspective view of a preferred embodiment of the invention.
Figure 2:
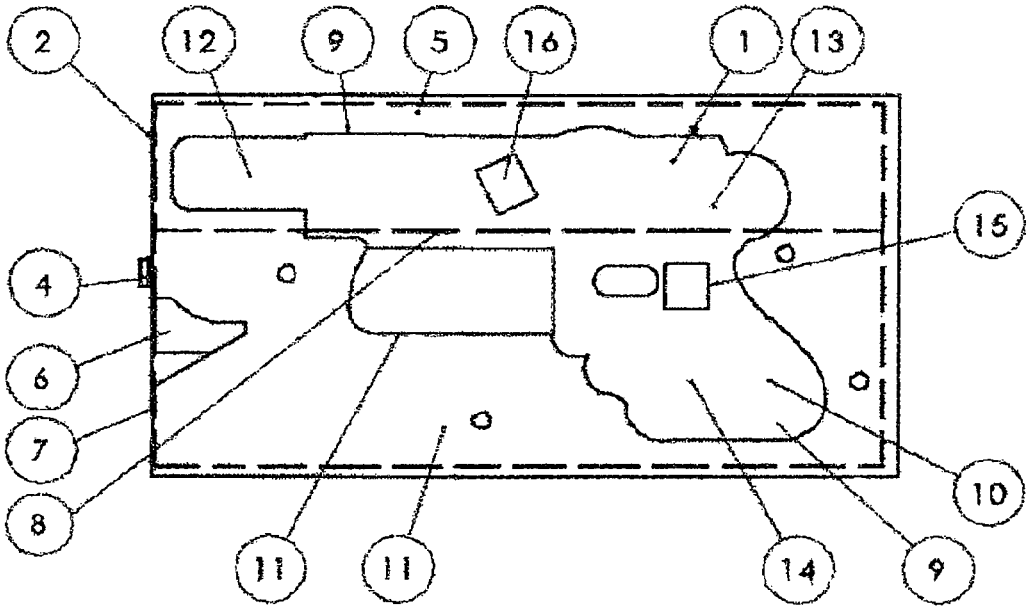
FIG. 2 is a schematic top plan view of the embodiment of FIG. 1.

Turning first to FIGS. 1-2, a Pistol Frame Disassembly Bed (hereinafter "PFDB" 2 is shown. The PFDB 2 is generally in the overall configuration of a box, and is comprised, generally, of a pistol bed 5 having a bed depression 10 for holding a pistol frame, a trigger mechanism housing aperture 6, and a drawer 7.

The top surface of the PFDB 2 incorporates the pistol bed 5. The pistol bed 5 is a three-dimensional depression, depressed in relation to the top of the PFDB 2. In this embodiment, a pistol to be disassembled is comprised of a slide assembly portion (Not shown) and a frame (receiver) portion 100, in FIG. 3. The pistol bed 5 is in the shape of a side of a pistol frame (receiver) 100, in FIG. 3, to accommodate it.

When manufactured, the pistol bed 5 will be sized and shaped to neatly and snugly accommodate a specific type of pistol. In this embodiment, for example, the pistol bed 5 and pistol bed wall 9, in FIGS. 1-2, within are shaped and of a depth to specifically accommodate a Glock™ generation 1-4 pistol model. The pistol bed wall 9 is about one-half inch high to accommodate part of the frame 100, in FIG. 3.

Overall, the PFDB 2 can be manufactured in any suitable size and configuration, depending upon such factors as what specific type of firearm the PFDB 2 is to accommodate and materials of construction. In this embodiment, to accommodate a Glock™ generation 1-4 pistol, the approximate dimensions of the PFDB 2 are approximately 10"L×6"W×3H.

Figure 5:
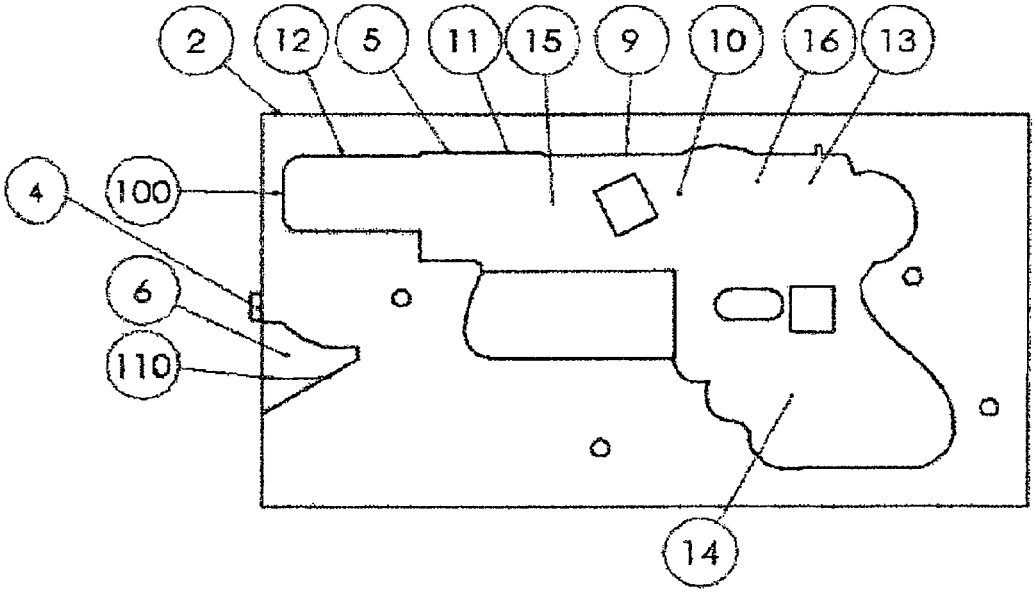
FIG. 5 is a schematic top plan view of the embodiment of FIG. 1 showing an aspect of the invention in use.

At a portion of the top of the PFDB 2, typically somewhat away from the pistol bed 5, if required by make and model, there can be a three-dimensional trigger mechanism housing aperture 6, in FIGS. 1-2, designed specifically to hold a trigger mechanism housing 110. In this embodiment, the trigger mechanism housing aperture 6 is roughly in the shape of a triangle with one curved side. Turning briefly to FIG. 5, the trigger mechanism housing aperture 6 is designed and shaped specifically to hold a Glock™ generation 1-4 pistol trigger mechanism housing with ejector 110, in FIG. 5, and in this embodiment, is located near the corner of the PFDB 2 furthest from the pistol bed 5 for convenient access.

Returning to FIGS. 1-2, a drawer 7 is located at the bottom of the PFDB 2. The drawer is slightly smaller than the length and width of the housing of the PFDB 2 and in this embodiment, it is about one inch in height. To open the drawer 7, a user simply holds the handle 4 (which can also be a recessed design drawer pull or other suitable apparatus to help open a drawer) and pulls the drawer from the PFDB 2. The drawer in this embodiment is designed to open from the front; however, it can be designed for convenience sake to open from any of the four sides, depending upon the pistol model. The drawer may optionally contain a divider 8 from front to back, or side-to-side, to help keep different parts separated, and for structural support if necessary.

Figure 3:
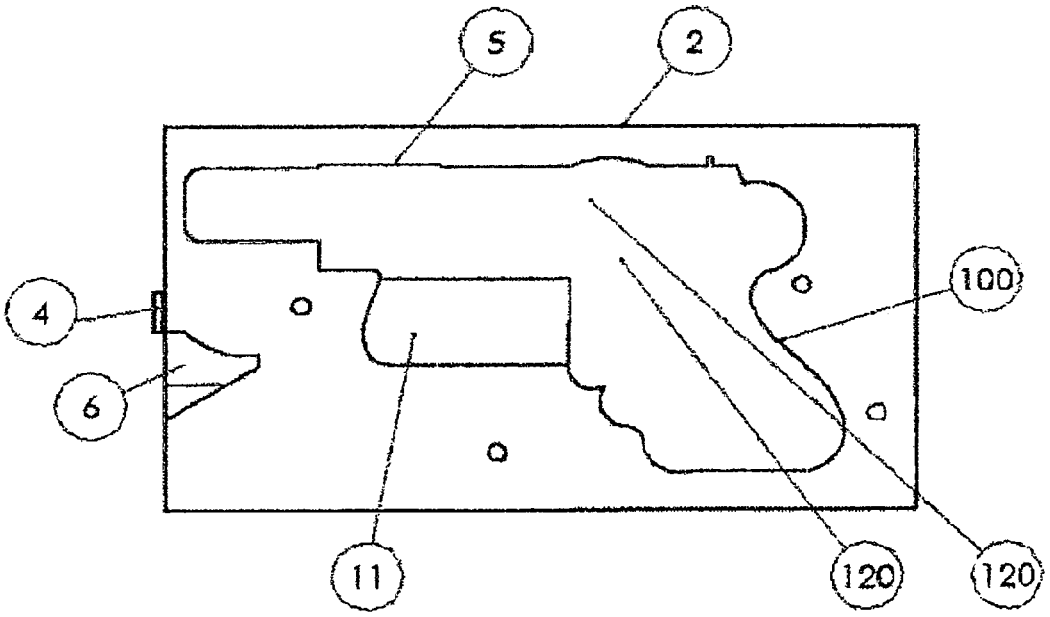
FIG. 3 is a schematic top plan view of the embodiment of FIG. 1 showing the invention in use.

Returning to discussion of the pistol bed 5, the pistol bed is typically comprised of several different general areas corresponding to portions of the frame 100, FIG. 3. In this embodiment, in FIGS. 1-2, the pistol bed 5 is generally comprised of a Forward frame area, 12, a Rear frame area 13, and a pistol grip receiving area 14.

Figure 4:
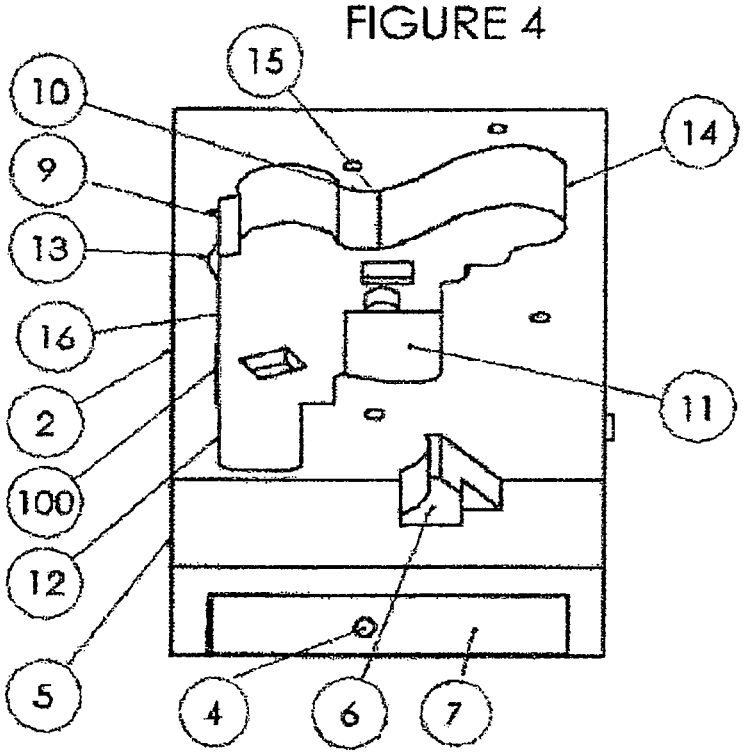
FIG. 4 is a schematic forward perspective view of the embodiment of FIG. 1.

The depth of the pistol bed 5 will typically vary slightly among the respective areas 12, 13, 14, in FIGS. 1-2, and within each area to accommodate the shape of the frame. The pistol bed 5 is further comprised of a depressed trigger guard area 11, which typically has a depth somewhat less than that of the rest of the pistol bed 5. In this embodiment the trigger guard area 11, in FIGS. 1-2, is about one-quarter inch deep to accommodate the trigger area of a Glock™ generation 1-4 pistol. Turning briefly to FIG. 4, the pistol bed 5 and bed wall 9 can be covered in a soft material to protect the pistol frame, or a protective coating can be placed in strategic areas of the pistol bed 5 to prevent scratching or other damage during the disassembly and reassembly process. The user will have complete control over the work as it sits in the PFDB 2.

The PFDB 2 has pass-through apertures, in this embodiment a pair of pass-through apertures, 15, 16, in FIG. 1-2 located at suitable locations on the pistol bed 5 that go through to the drawer 7 below.

Turning to FIG. 3, an example of use of the PFDB 2 will be discussed. A firearm, in this embodiment a Glock™ generation 1-4 pistol, is provided. As stated previously, though, the pistol to be worked on can be of any suitable type for disassembly and reassembly.

As a critical first step, the user of a PFDB 2 should always insure that the firearm is not loaded.

In a second step, the user separates the slide assembly (not shown) from the frame 100, in FIG. 3, as well as from any magazine. Any added modifications or additions to the basic frame 100 of the pistol, such as a frame mounted light or laser unit, must be removed so that the pistol frame 100 will fit into the pistol bed 5.

In a third step the user places the frame 100, FIG. 3, on its side and into the appropriate side of the pistol bed 5 into which it will fit.

In a fourth step, with the Generation 1 through Generation 4 Glock™ pistol model of this embodiment, in FIG. 3, the user removes the Locking Block Pin 120 and or Trigger Pin 124, as required by specific models, such as Glock™ models G42 and G43. The user typically will use a punch-style tool and usually a small hammer (not shown).

The pass-through apertures 15, 16 (not visible here. See FIGS. 1-2), are positioned in the pistol bed 5 such that they are directly under the pins 120, 122 124, FIG. 3, when the frame 100 is placed in the pistol bed 5. The user strikes or punches the pins 120, 122, 124, in the frame 100. The pins 120, 122, 124, when punched out, can fall safely and without damage through the pass-through apertures 15, 16 (See FIGS. 1-2) and into the removable drawer 7. The drawer 7 can not only catch and hold the pins but can also be used to store small tools, and parts (not shown) used in the maintenance process.

In a fifth step, the user can use a punch, punch-style tool, or other appropriate tool(s) to safely remove the connector. This is often done with the use of a screwdriver or similar tool which could potentially damage the connector.

Moving briefly to FIG. 5, in a sixth step, the user removes the trigger mechanism housing 110 from the frame 100, and places the trigger mechanism housing 110 in the trigger mechanism housing aperture 6, facing downward. The user can then push the connector 128 out through the other side of the trigger mechanism housing 110. The connector falls from the trigger mechanism housing aperture 6 and into the provided recessed area.

The trigger mechanism housing aperture 6, FIG. 1-2, is roughly in the shape of a triangle with one curved side, and herein, is designed in size and shape to hold the Trigger Mechanism Housing of a Glock™ generation 1-4 pistol. The trigger mechanism housing aperture 6, FIGS. 1-2, like the other parts herein, can be of any appropriate dimension for the pistol(s) for, which the PFDB 2 is being used. In this embodiment, the trigger mechanism housing aperture 6 is two inches or slightly less in length and width to accommodate a recess for capture of the connector, and it has a two-level depth of one-half inch and three-quarters of an inch, respectively.

In a seventh step, when a user wishes to reassemble the pieces, of the receiver 100, FIG. 3, the user first reassembles and installs the trigger mechanism housing 110. The user should secure the pistol frame 100 back into the pistol bed 5 for increased stability. Then the user can install (on applicable models) the trigger pin 124, the trigger housing pin 122, and the locking block pin 120. The user can hold the pistol frame 100 in place in the pistol bed 5 while tapping or pushing the pins back into the receiver 100.

The materials of construction of the PFDB 2, or its constituent parts, can be any as known and suitable in the art, including but not limited to wood, metal, plastic or resin, or other suitable materials. The size and materials of construction of the PFDB 2 and its individual parts may vary, depending on several factors, such as the pistol(s) the unit is designed for, the materials of construction and manufacturing process used. To achieve the desired strength, durability and efficiency of the PFDB 2, the planning, design and manufacturing stage will determine the exact size of the PFDB 2 depending upon the material used.

The PFDB 2 can be produced in a number of different, or even slightly different, models. For example, the basic pistol bed 5 and configuration of bed wall 9, FIG. 1-2, of the PFDB 2 can be modified to accommodate different designs, sizes and shapes of pistols, of various manufacturers. With the correct model PFDB 2, the user can perform the recommended maintenance for any pistol that requires the removal of components for disassembly and reassembly.

Disclosed herein is a device for assisting with the disassembly and reassembly of pistol components and for maintenance or upgrades such as the installation of improved slide locks or a trigger connector of a different pressure rating. Accordingly, a device and method of use is provided to users resulting in a steady platform with which to disassemble and reassemble pistols when necessary, which makes the pistol stable, safe, and prevents disastrous loss of parts and or damage to the pistol.

It is to be understood that while certain forms of the present invention have been illustrated and described herein, the expression of these individual embodiments is for illustrative purposes and should not be seen as a limitation upon the scope of the invention. It is to be further understood that the invention is not to be limited to the specific forms or arrangements of parts described and shown.

The invention claimed is:

1. A firearm disassembly bed comprised of a bed having a bed depression configured to hold a firearm frame within the bed depression, wherein the bed depression is a three-dimensional depression incorporated at the top surface of the firearm frame disassembly bed and wherein the bed depression is configured generally in the shape of a portion at least one firearm component, so as to accommodate the at least one firearm component, at least one aperture located within the firearm bed depression, and a receptacle portion located beneath the bed depression capable of receiving at least one firearm component through the aperture.

2. The firearm frame disassembly bed of claim 1, wherein the firearm is a pistol.

3. The firearm frame disassembly bed of claim 1, wherein the firearm frame disassembly bed is further comprised of a generally triangular-shaped trigger mechanism housing aperture, located on a portion of the top surface away from the bed depression.

4. The firearm frame disassembly bed of claim 3, wherein, the trigger mechanism housing aperture is one-and-a-half inches to two inches in length.

5. The firearm frame disassembly bed of claim 1, wherein the receptacle portion is comprised of at least one drawer that is slightly smaller than the length and width of the housing of the firearm frame disassembly bed.

6. The firearm frame disassembly bed of claim 5, wherein the drawer is one inch in height.

7. The firearm frame disassembly bed of claim 5, wherein the drawer is further comprised of a handle.

8. The firearm frame disassembly bed of claim 5, wherein the drawer is further comprised of at least one divider capable of keeping multiple components in the drawer separated.

9. The firearm frame disassembly bed of claim 1, wherein the at least one firearm component is a frame or receiver.

10. The firearm frame disassembly bed of claim 1, wherein the side of the bed depression is between one-quarter inch and one inch in height.

11. The firearm frame disassembly bed of claim 1, wherein the side of the bed depression is one-half inch in height.

12. The firearm frame disassembly bed of claim 1, wherein the dimensions of the firearm disassembly bed are about 10 inches in length, six inches in width, and three inches in height.

13. The firearm frame disassembly bed of claim 1, wherein the bed depression is generally comprised of a Forward frame area, a rear frame area, and a pistol grip receiving area.

14. The firearm frame disassembly bed of claim 1, wherein the bed depression is further comprised of a trigger guard area, and wherein the trigger guard area has a depth less than the remainder of the bed depression.

15. The firearm frame disassembly bed of claim 1, wherein at least part of the bed depression is covered in a material softer than the surface of the bed depression, a protective coating or a combination of both.

16. The firearm frame disassembly bed of claim 1, wherein the at least one aperture in the depression bed is 2-4 apertures.

17. The firearm frame disassembly bed of claim 1, wherein the bed is constructed of wood, metal, plastic or other resin, or combination of any of these.

* * * * *